US009487882B2

(12) United States Patent
Kita et al.

(10) Patent No.: US 9,487,882 B2
(45) Date of Patent: Nov. 8, 2016

(54) TITANIUM MATERIAL AND METHOD FOR PRODUCING TITANIUM MATERIAL

(75) Inventors: Hayato Kita, Osaka (JP); Futoshi Katsuki, Osaka (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 13/139,310

(22) PCT Filed: Dec. 17, 2008

(86) PCT No.: PCT/JP2008/072947

§ 371 (c)(1),
(2), (4) Date: Jun. 13, 2011

(87) PCT Pub. No.: WO2010/070742

PCT Pub. Date: Jun. 24, 2010

(65) Prior Publication Data

US 2011/0244266 A1 Oct. 6, 2011

(51) Int. Cl.

| | |
|---|---|
| ***B32B 15/01*** | (2006.01) |
| ***C25F 1/00*** | (2006.01) |
| ***C25F 1/04*** | (2006.01) |
| ***C25F 1/08*** | (2006.01) |
| ***C23C 28/04*** | (2006.01) |

(52) U.S. Cl.

CPC ..... *C25F 1/08* (2013.01); *C23C 28/042* (2013.01); *C23C 28/044* (2013.01); *Y10T 428/12493* (2015.01)

(58) Field of Classification Search

None

See application file for complete search history.

(56) References Cited

U.S. PATENT DOCUMENTS

| | | | | |
|---|---|---|---|---|
| 5,464,524 | A | 11/1995 | Ogiwara et al. | |
| 5,939,201 | A * | 8/1999 | Boire et al. | 428/432 |
| 2002/0191878 | A1 * | 12/2002 | Ueda et al. | 384/492 |

FOREIGN PATENT DOCUMENTS

| | | | | |
|---|---|---|---|---|
| EP | 1 264 913 | | 12/2002 | |
| EP | 1 887 094 | | 2/2008 | |
| JP | 02159478 | A * | 6/1990 | 277/650 |
| JP | 06-346300 | | 12/1994 | |
| JP | 07-180087 | | 7/1995 | |
| JP | 2002-012962 | | 1/2002 | |
| JP | 2002-120495 | | 4/2002 | |
| JP | 2005-154882 | | 6/2005 | |
| JP | 2005-240139 | | 9/2005 | |
| JP | 2005-298930 | | 10/2005 | |
| JP | 2006-063406 | | 3/2006 | |
| JP | 2009-097060 | | 5/2009 | |

OTHER PUBLICATIONS

Leng et al. Surface & Coatings Technology, 201, (2006), 1012-1016.*

Takeshi Sawa, IMEKO 2010 TC3, TC5 and TC22 conferences, Nov. 22-25, 2010.*

* cited by examiner

*Primary Examiner* — Vera Katz

(74) *Attorney, Agent, or Firm* — Clark & Brody

(57) ABSTRACT

Disclosed are a titanium material having excellent surface characteristics and a method for readily producing a titanium material having excellent surface characteristics. More specifically, provided is a titanium material including a surface film having a multilayer structure provided with at least two layers, namely a surface layer and an inner layer in contact with the inner side of the surface layer, wherein the surface layer is formed of titanium oxide with a hardness of 5 GPa to 20 GPa, and the inner layer contains at least one of titanium carbide and titanium nitride.

2 Claims, 4 Drawing Sheets

TITANIUM MATERIAL AND METHOD FOR PRODUCING TITANIUM MATERIAL

FIELD OF THE INVENTION

The present invention relates to a titanium material and a method for producing the titanium material.

RELATED ART

Having high specific strength and excellent corrosion resistance, titanium is widely used in various applications such as use for chemical plant, use for seawater resistance, use for architecture (e.g., armoring material and roofing material), use for aerospace, and use for popular supplies (e.g., eyeglasses and sports gears).

Due to the use in various fields, a titanium member (titanium material) is required to have homogeneous, good-looking surfaces.

Accordingly, in production of a titanium material, surface characteristics of the material need to be strictly controlled.

A titanium material has been conventionally produced from an ingot made of remelted sponge titanium and variously processed by forging, rolling, or extrusion into various forms for use such as a thick plate, a thin plate, a stick, a wire, or a pipe.

For example, a thin plate product such as a foil is produced by the successive steps of forging an ingot into a slab, hot-rolling the slab into a hot coil having a thickness of several millimeters, and cold-rolling the coil.

In the step of cold rolling, a long coil is repeatedly rolled and annealed for producing a titanium foil having a predefined thickness and strength.

In contrast, a titanium plate to be processed by pressing is finished by annealing.

Since titanium has high activity and high affinity to oxygen compared to other commonly-used metals, a titanium material usually has a layer mostly formed of titanium oxide with a thickness of several nm to several tens of nm on the surface.

Due to the formation of the surface film mostly formed of the oxide, a titanium material has excellent corrosion resistance.

Titanium readily forms a compound with carbon, nitrogen, or hydrogen, which is other than oxygen, to produce carbide, nitride, or hydride of titanium on the surface, resulting in significant change in surface characteristics.

In particular, a thin plate product such as a titanium foil is significantly affected by these compounds.

The surface film of oxide is mainly formed during annealing in production, though the film may be formed in the air even during unattended period in some instances.

The formation of the surface film has a significant effect on the surface characteristics of the titanium material in later phases.

As a process for controlling the formation of the surface film, annealing and pickling, vacuum annealing, or bright annealing has been conventionally performed.

In annealing and pickling among those, a known process includes successive steps of heating in the air or combustible gas such as natural gas, modifying scale with immersion in a molten alkali salt bath (salt treatment), and acid washing for descaling with a mixed acid of hydrofluoric acid and nitric acid.

In the annealing and pickling, thick oxidized scale is formed during heating, and the oxidized scale is to be removed by acid washing while bare metal is dissolved. As a result, a large yield loss occurs. In particular, the yield loss is larger in production of a thin plate product such as a titanium foil.

In contrast, vacuum annealing, which is a process of heating a long coil in a vacuum annealing furnace, and bright annealing, which is a process of annealing in non-oxidizing gas atmosphere, produce no oxidized scale, enabling preserving rolled gloss through annealing with a high yield.

Accordingly, the processes are suitable for forming a titanium material such as a titanium foil.

In particular, bright annealing is an economical process, enabling continuous annealing by splicing long coils.

The bright annealing is also used for processing stainless steel with using a nonoxidizing gas such as nitrogen, hydrogen, or mixed gas thereof (AX gas) during annealing.

In contrast, argon gas is used as a nonoxidizing gas for preserving characteristics of a titanium material, because titanium reacts with nitrogen or hydrogen at high temperature to form nitride or hydride, resulting in possible degradation of the characteristics.

In some instances, however, facilities for producing titanium materials and stainless steel materials are commonly-utilized, resulting in nitrogen or hydrogen remaining in the bright annealing furnace under certain circumstances when a titanium material is produced.

In addition, because carbon components derived from rolling oil remain on the surface of the cold rolled titanium coil, carbide or nitride may be formed on the surface of the titanium foil.

Due to the difficulty of thoroughly preventing interfusion of nitrogen and carbon, it is difficult to control the formation of nitride or carbide.

Since it is known that the titanium carbide reduces corrosion resistance, removal thereof from the surface of a titanium material has been considered.

For example, Patent Document 1 describes that the surface portion of a titanium material is mechanically or chemically removed by 1 μm or more in order to remove titanium carbide from the surface for enhancing corrosion resistance.

Patent Document 2 describes that an oxide layer is formed on the surface of a titanium material by immersing the titanium material into nitric acid or applying nitric acid to the titanium material.

In the methods for producing a titanium material as described in the Patent Documents, the surface removal treatment is performed to reduce a carbon content to a given amount in the region from the surface to a predefined depth, resulting in unavoidable drive to formation of titanium nitride or the like in the surface layer.

Accordingly, the methods for producing a titanium material as described in the Patent Documents do not sufficiently reduce the possibility of degradation of the characteristics of a titanium material.

In addition, since carbide or nitride of titanium is extremely hard, the formation of the carbide or nitride of titanium on the surface of a titanium material causes reduction of the surface lubricity.

As a result, for example, when a titanium plate having a surface formed of carbide or nitride is pressed, the sheared carbide or nitride may cause scratches on the surface of a pressed product.

Also, the carbide or the nitride adhered to the mold surface may cause an indentation on the product.

In some instances, coating or plating is applied to a titanium material for further enhancing the surface characteristics such as corrosion resistance or electrical conductivity or for aesthetic purposes.

In some instances, the surface is etched with acidic liquid as a pretreatment prior to coating or plating. In this case, the carbide or nitride of titanium formed on the titanium material may cause variation in the state of the etched surface to reduce adhesion of the coating or plating film.

Conventionally, achievement of the characteristics required for the surface of a titanium material such as lubricity, corrosion resistance, and homogeneity has not been sufficiently examined, and the methodology thereof has not been established.

Also, the method for efficiently producing such a titanium material has not been sufficiently examined nor established.

These problems exist not only in a thin plate product such as a titanium foil but also in various forms of titanium materials such as a thick plate, a stick, a wire, or a pipe in common.

Patent Document 1: Japanese Patent Application Laid-Open No. 2002-12962

Patent Document 2: Japanese Patent Application Laid-Open No. 2005-154882

DISCLOSURE OF THE INVENTION

Problems to be Solved by the Invention

In view of the foregoing problems, it is an object of the present invention to provide a titanium material having excellent surface characteristics and a method for readily producing the titanium material having excellent surface characteristics.

Means for Solving Problems

In order to solve the foregoing problems, the present invention provides a titanium material including a surface film having a multilayer structure provided with at least two layers, namely a surface layer and an inner layer in contact with the inner side of the surface layer, the surface layer being formed of titanium oxide with a hardness of 5 GPa to 20 GPa, the inner layer containing at least one of titanium carbide and titanium nitride.

In order to solve the foregoing problems, the present invention also provides a method for producing a titanium material including a surface film having a surface layer formed of titanium oxide, comprising the successive steps of making a titanium material including a surface layer containing at least one of titanium carbide and titanium nitride; and then electrolytically pickling the titanium material in acidic aqueous solution or neutral aqueous solution containing an oxidizing reagent to dissolve a portion of the layer containing at least one of titanium carbide and titanium nitride and form a titanium oxide layer on the surface at the same time, thereby forming the surface film having a multilayer structure provided with the surface layer and an inner layer containing at least one of titanium carbide and titanium nitride in contact with the inner side of the surface layer so that the surface layer has a hardness of 5 GPa to 20 GPa.

As used herein, the term "titanium material" refers to not only a product formed of pure titanium but also a product formed of titanium alloy.

The expression "containing at least one of titanium carbide and titanium nitride" refers to both "containing either one of titanium carbide or titanium nitride" and "containing both of titanium carbide and titanium nitride".

Advantages of the Invention

A titanium material of the present invention includes a surface film having a multilayer structure provided with at least two layers, namely a surface layer formed of titanium oxide and an inner layer in contact with the inner side of the surface layer. The surface layer has a hardness of 5 GPa to 20 GPa and the inner layer contains at least one of titanium carbide and titanium nitride.

Due to the soft surface layer and the hard inner layer, excellent surface lubricity of a titanium material is achieved.

Due to the surface layer formed of titanium oxide, excellent surface homogeneity and corrosion resistance of a titanium material is achieved.

Accordingly, the present invention provides a titanium material having excellent surface characteristics.

In the method for producing a titanium material of the present invention, a titanium material having a surface layer containing at least one of titanium carbide and titanium nitride is made and subsequently electrolytically pickled in acidic aqueous solution or neutral aqueous solution containing an oxidizing reagent, such that a portion of the layer containing at least one of titanium carbide and titanium nitride is dissolved while a titanium oxide layer is formed on the surface, resulting in the formation of the titanium oxide layer on the surface of the layer containing at least one of titanium carbide and titanium nitride.

Accordingly, for example, electrolytic pickling alone after bright annealing enables formation of the surface layer of titanium oxide without mechanical polishing of the surface or immersion in nitric acid for long hours.

The formation of the surface layer by electrolytic pickling enables homogeneity in surface layer, enhancing adhesion to a coating film or a plating film.

The formation of a homogeneous surface layer of titanium oxide enables production of a titanium material having excellent corrosion resistance.

Furthermore, a surface film having a multilayer structure provided with an inner layer containing at least one of titanium carbide and titanium nitride in contact with the inner side of the surface layer is formed on the surface of a titanium material such that the surface layer has a hardness of 5 GPa to 20 GPa, enabling production of a titanium material having excellent surface lubricity.

As a result, a titanium material having excellent surface characteristics is readily produced according to the present invention.

DESCRIPTION OF REFERENCE NUMERALS

Figure 1:
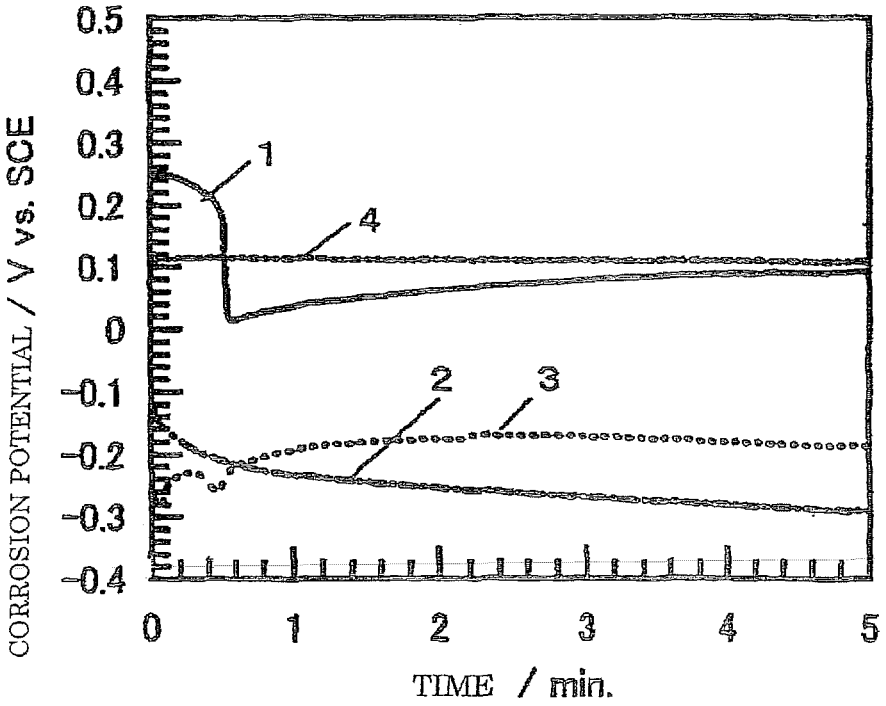
FIG. 1 is a graph showing corrosion potential variations with time.

1: titanium foil, 2: tank (electrolysis tank), 3: electrolysis solution, 4 electrode, 5: energizing roll

DETAILED DESCRIPTION OF THE PREFERRED EMBODIMENT

With reference to an exemplary titanium foil, a titanium material of the present embodiment is described below.

The titanium foil of the present embodiment is generally formed into a thickness of 0.05 mm to 0.5 mm.

The titanium foil includes a surface film having a two-layer structure provided with a surface layer of titanium oxide and an inner layer in contact with the inner side of the surface layer.

The surface layer is generally formed into a thickness of not less than 5 nm with a hardness of 5 GPa to 20 GPa.

Because the surface layer having a thickness of not less than 100 nm causes interference colors on the surface of the titanium material, the preferred thickness of the surface layer is less than 100 nm for furnishing the titanium material with appearance inherent to titanium or for enhancing aesthetic value of the titanium material with a coating film formed on the surface.

The hardness of the surface layer may be measured by nanoindentation.

More specifically, using "Triboscope" made by Hysitron Corporation, a diamond probe with a tip angle of 90 degrees is pressed into the surface of the titanium material at a loading rate of 400 μN/s until the load reaches 100 μN at room temperature in the air. Then, after unloading is performed at the same loading rate, the load (P) and the projected area (A) of the probe-contacting portion are measured. From the measured values, the hardness (H) is calculated based on the following equation (1).

$$H=P/A \quad (1)$$

As used herein, the expression "hardness by nanoindentation" (hereinafter abbreviated as "hardness") refers to the hardness measured by the method described above unless particularly described otherwise.

The inner layer contains at least one of titanium carbide and titanium nitride, being generally harder than the surface layer of titanium oxide.

The configuration that the inner layer is harder than the surface layer may be confirmed, for example, with hardness measurement by changing the indentation depth with the measuring load using a Vickers hardness tester, because Vickers hardness rises until the indentation depths from the surface reaches a certain level of depth and declines thereafter.

Since the titanium foil includes a surface film having a soft surface layer with a hardness of 5 GPa to 20 GPa and a hard layer containing at least one of titanium carbide and titanium nitride on the inner side of the surface layer as described above, the excellent surface lubricity is achieved.

Furthermore, since the soft surface layer is formed of titanium oxide, the titanium foil may have excellent corrosion resistance.

A method for producing such a titanium foil is described below.

First, industrial pure titanium is hot rolled into a primary half-finished product in the form of a plate.

Subsequently, the primary half-finished product is repeatedly subject to cold rolling, annealing in a combustion gas atmosphere, and acid washing, to make a secondary half-finished product with a thickness of about 0.5 mm.

Furthermore, the secondary half-finished product is successively subject to cold rolling, annealing, and electrolytic pickling to make a titanium foil with a thickness, for example, of about 0.2 mm.

During annealing of the secondary half-finished product, titanium carbide or titanium nitride is formed on the surface of the titanium foil. Subsequently, the carbide or the nitride is dissolved by electrolytic pickling in acidic aqueous solution or neutral aqueous solution containing an oxidizing reagent while a surface layer of titanium oxide is formed on the surface by acceleration of surface oxidation at the same time.

Through appropriate selection of conditions for annealing and electrolytic pickling of the secondary half-finished product, the inner layer of the remaining titanium carbide or titanium nitride is formed on the inner side of the surface layer of titanium oxide.

As a method for annealing the secondary half-finished product, preferably vacuum annealing or bright annealing is employed for controlling formation of the scale to reduce the yield loss.

Examples of the acidic aqueous solution used for the electrolytic pickling include nitric acid aqueous solution and sulfuric acid aqueous solution.

Examples of the neutral aqueous solution containing an oxidizing reagent include neutral aqueous solution containing nitrate ion, chromium ion ($Cr^{6+}$), hydrogen peroxide, or ozone.

Of them, in particular, use of nitric acid aqueous solution alone is preferable because of ease of the waste liquid treatment and the economical cost.

In the case of using the nitric acid aqueous solution alone, preferably the concentration ranges from 1 wt % to 10 wt % in order to reduce the possibility of tarnish of the titanium foil due to excessive progress of surface oxidation.

On this occasion, preferably the temperature for the use ranges from normal temperature to 60° C., more preferably from normal temperature to 40° C.

In the electrolytic pickling, anode electrolysis or alternating electrolysis that alternates anode electrolysis and cathode electrolysis may be employed.

Figure 5A:
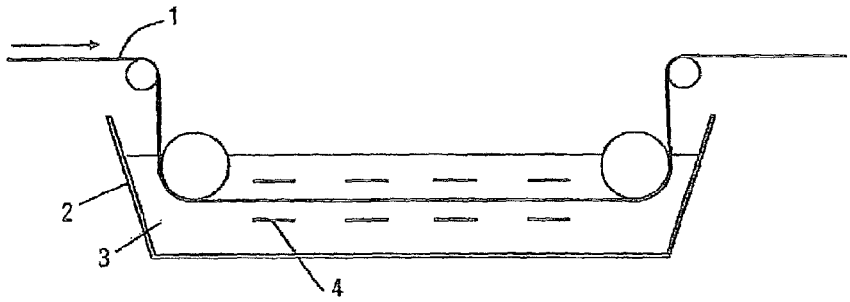
FIG. 5 are schematic side views each illustrating an electrolytic apparatus.
Figure 5B:
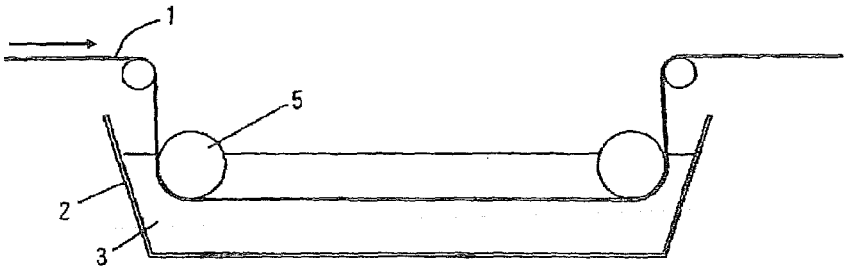

In the electrolytic pickling, a continuous line for passing a titanium foil 1 into a tank 2 (electrolysis tank 2) for storing electrolytic solution 3 (e.g., the acidic aqueous solution) may be used as shown in FIG. 5. The electrolytic pickling may be performed, for example, by using facilities (FIG. 5 (*a*)) for indirect energizing of the titanium foil 1 passing between electrodes 4 arranged one above the other in immersed state in the acidic aqueous solution 3, or by using facilities (FIG. 5 (*b*)) for direct energizing of the titanium foil 1 with an energizing roll 5.

The time period for the electrolytic pickling may be determined based on the time period for the anode electrolysis. In the cases of performing the anode electrolysis alone or performing the alternating electrolysis, the total time period for the anode electrolysis may be appropriately selected in the range 3 sec or more and 60 sec or less in general.

The anode electrolysis in the electrolytic pickling may be generally controlled by either one of electric potential or electric current.

In controlling electric potential, it is important to set the potential at higher than the dissolution potential of titanium carbide of 1.56 V. Preferably the potential is controlled at 1.60 V or higher.

In alternating electrolysis, preferably the potential during anode electrolysis is controlled at 1.60 V or higher in process of the repeated cathode electrolysis and anode electrolysis.

Although the upper limit of the potential is not specifically limited, an excessively high potential may cause coloring on the surface of the titanium foil or surface defect due to spark. Accordingly, the upper limit may be generally determined in consideration of the surface conditions of the titanium foil to be produced.

In the case of controlling electric current, the Coulomb amount (product of current density and electrolysis time) during anode electrolysis is generally controlled in the range from 1 C/dm$^2$ to 100 C/dm$^2$.

In alternating electrolysis, the Coulomb amount during anode electrolysis is controlled in the range of 1 C/dm$^2$ to 100 C/dm$^2$ in process of the repeated cathode electrolysis and anode electrolysis.

The cathode electrolysis is generally performed with a Coulomb amount of 1 C/dm$^2$ to 100 C/dm$^2$ or at an electric potential of 1.6 V or higher for the time period 3 sec or more and 60 sec or less as described above, enabling formation of the surface layer having a hardness in the range of 5 GPa to 20 GPa, Optionally, cold rolling may be further performed after the electrolytic pickling for producing a thinner titanium foil.

As required, the electrolytic pickling may be further performed between the steps of cold rolling and annealing, enabling reduction of the formation of titanium carbide during annealing resulting from the removal of lubricant oil adhered during cold rolling.

Using such producing methods, a titanium material having excellent surface lubricity and corrosion resistance is readily produced.

A titanium foil is exemplified in the present embodiment with more significant advantageous effects of the present invention, because disfigurement is visibly prominent in the large surface area and the yield loss by acid washing is noticeable. In the present invention, however, the titanium material is not limited to a titanium foil. The present invention enables providing advantageous effects on titanium materials in various forms such as a wire or a pipe as well as a titanium foil.

EXAMPLES

While the present invention is further described with reference to examples below, the present invention is not limited thereto.

Using an industrial pure titanium material (JIS Class 1) in accordance with JIS, a hot coil having a thickness of 4 mm was made, and then was subjected to annealing and pickling, and was cold rolled until the work thickness reached 0.5 mm.

Subsequently, annealing and pickling were performed, and a titanium foil having a thickness of 0.2 mm was produced by cold rolling.

Examples 1 and 2

The titanium foil having a thickness of 0.2 mm was bright annealed in a bright annealing furnace utilizing 100% argon gas with a dew point of −40° C. at 720° C. for 2 minutes.

After the bright annealing, electrolytic pickling was performed in 6 wt % nitric acid aqueous solution at 25° C. with a Coulomb amount of 20 C/dm$^2$ for making the titanium foil in Example 1.

The titanium foil in Example 2 was made as in Example 1 except that electrolytic pickling was performed with a Coulomb amount of 80 C/dm$^2$.

Comparative Examples 1 and 2

The titanium foil in Comparative Example 1 was made as in Example 1 except that the titanium foil having a thickness of 0.2 mm was subjected to bright annealing alone and was not subjected to electrolytic pickling.

The titanium foil in Comparative Example 2 was made as in Comparative Example 1 except that annealing and pickling (annealing, salt treatment, and hydrofluoric-nitric acid pickling) only were performed in place of bright annealing.

Reference Example 1

The surface of the titanium foil having a thickness of 0.2 mm was dry polished with an emery paper 1200 grit to produce the titanium foil in Reference Example 1.

<Evaluation of Corrosion Resistance>

Each of the titanium foils in Example 1, Comparative Examples 2 and 3, and Reference Example 1 was immersed in 5 wt % sulfuric acid aqueous solution for the measurement of the corrosion potential variations with time. The results are shown in FIG. 1.

From FIG. 1, it is recognized that a sharp potential decrease occurred to the titanium foil in Comparative Example 1 ("1" in FIG. 1) within about 30 sec from the beginning of the measurement, showing that components easily soluble in acid were present in the surface, of which composition was inhomogeneous.

The titanium foils in Reference Example 1 ("2" in FIG. 1) and Comparative Example 2 ("3" in FIG. 1) indicated negative potentials from the beginning of the measurement, showing that these surface films had poor corrosion resistance.

On the other hand, Example 1 ("4" in FIG. 1) indicated stable positive potentials from the beginning of the measurement, showing that a surface film having a homogeneous composition and excellent corrosion resistance was formed.

<Elemental Analysis of the Surface>

On the surfaces of the titanium foils in Example 1 and Comparative Example 1, electron spectroscopy for chemical analysis (ESCA) was performed.

The ESCA was performed with "Quantera SXM" available from ULVAC-PHI Inc., using a mono-Al—Kα line with a beam diameter of 200 μm as an X ray source.

On this occasion, the detection depth was several nm.

Figure 2A:
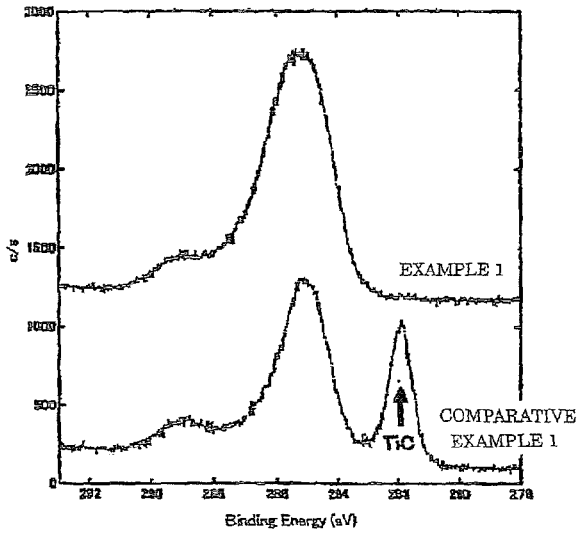
FIG. 2 are charts each showing ESCA analysis.
Figure 2B:
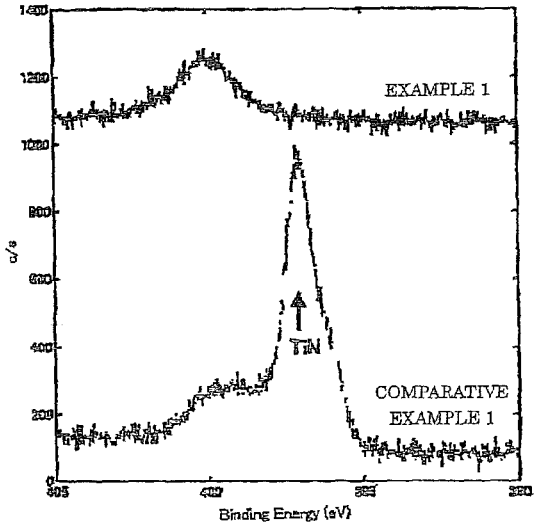
Figure 2C:
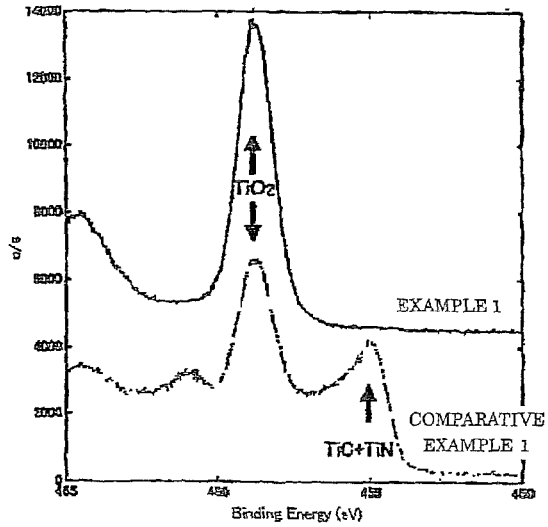

Enlarged views of characterizing portions of the ESCA charts for the titanium foils in Example 1 and Comparative Example 1 are shown in FIGS. 2 (*a*) to 2 (*c*).

In the chart for the foil finished with bright annealing in Comparative Example 1, as well as the peak in the vicinity of 459 eV indicating the presence of $TiO_2$, each of the peak in the vicinity of 282 eV indicating the presence of TiC, the peak in the vicinity of 397 eV indicating the presence of TiN, and the peak in the vicinity of 455 eV indicating the presence of TiC and TiN was clearly observed to show the inhomogeneity in composition of the surface.

In contrast, in the chart for the titanium foil in Example 1, only a weak peak in the vicinity of 285 eV indicating the presence of organic carbon and a peak in the vicinity of 400 eV indicating the presence of organic nitrogen were observed other than the peak indicating the presence of $TiO_2$.

In addition, it was recognized that since those at 285 eV and 400 eV were derived from the contamination due to adherents, the surface was homogeneously formed of titanium oxide.

<Evaluation of Rollability (Workability)>

The titanium foils in Examples 1 and 2 and Comparative Examples 1 and 2 with a thickness of 0.2 mm, a width of 500 mm, and a length of 1300 m were further cold rolled into a thickness of 0.1 mm with a work roll made of forged 2% chromium steel.

On this occasion, the rolling force was measured at the first pass with a rolling reduction of about 15%.

At the same time, the presence or absence of debris adhered to the work roll was visually determined.

Furthermore, the wear depth of the work roll was measured. The wear depth was determined by multiplying the difference in the measured diameters of the work roll before and after rolling by one half.

In addition, after the titanium foil was rolled into a thickness of 0.1 mm, the presence or absence of abrasion powder on the foil was visually determined.

The results are shown in Table 1.

Prior to the rolling, hardness of the titanium foils in Examples 1 and 2 and Comparative Examples 1 and 2 was measured by nanoindentation. The results are also shown in Table 1.

TABLE 1

| | Producing process | | Surface | Evaluation results of rollability | | | |
|---|---|---|---|---|---|---|---|
| | | | | Rolling | Debris | Wear depth | |
| | Annealing | Electrolytic pickling | hardness* (GPa) | force (ton) | adhered to roll | of roll (mm) | Abrasive powder |
| Example 1 | Bright annealing | 20 C/dm$^2$ | 19 | 35 | Absent | 0.03 | Absent |
| Example 2 | Bright annealing | 80 C/dm$^2$ | 5 | 30 | Absent | 0.01 | Absent |
| Comparative Example 1 | Bright annealing | Absent | 25 | 60 | Present | 0.10 | Absent |
| Comparative Example 2 | Annealing and acid washing | Absent | 3 | 185 | Absent | 0 | Present |

*Measurement results by nanoindentation

From the results shown in Table 1, it can be seen that the rolling of the titanium foil in Comparative Example 1 caused significant wear of the roll.

Furthermore, a number of debris adhered to the roll surface were observed, and a number of scratches were observed on the rolled titanium foil.

It is believed that since the titanium foil in Comparative Example 1 had a high surface hardness of 25 GPa, the surface of the work roll was gradually scraped off during rolling.

It is assumed that the debris adhered to the surface of the work roll were derived from a flaked portion of the surface film during rolling. In other words, it is believed that the inhomogeneous composition of the surface caused the local transfer.

In the rolling of the titanium foil in Comparative Example 2, while the debris to the roll or the wear of the roll did not occur at all, the rolling force was significantly large and the surface of the rolled titanium foil had a severely damaged appearance stained in black.

It is believed that since the surface hardness was excessively low contrary to the titanium foil in Comparative Example 1, abrasive powder that was produced from a flaked portion of the titanium foil deposited on the overall surface of the work roll to increase the friction between the roll and the titanium foil, resulting in the increase of the rolling force.

It is also believed that the abrasive powder got mixed in rolling oil to readhere to the surface of the titanium foil resulting in the formation of the black stain.

In contrast, with regard to the titanium foils in Examples 1 and 2, the rolling force was low, the debris to the roll did not occur, and the wear depth of the roll was reduced to a large extent.

Furthermore, it was shown that the rolled titanium foil had a good-looking appearance and abrasive powder did not occur.

Accordingly, it was shown that the present invention provides a titanium foil with excellent surface lubricity, resulting in providing the titanium foil with stable workability through the process without scraping either one of the surfaces of the work roll or the titanium foil.

Examples 3 to 5 and Comparative Example 3

The titanium foil in Comparative Example 3 was made as in Example 1 except that the electrolytic pickling was performed by controlling the electric potential at +1.0 V that was lower than the dissolution potential of titanium carbide of 1.56 V, such that the titanium foil was produced on the condition with a surface hardness of higher than 20 GPa.

The titanium foil in Example 3 was made as in Comparative Example 3 except that the electrolytic pickling was performed at the potential of +1.6 V.

The titanium foil in Example 4 was made as in Example 3 except that the electrolytic pickling was performed at the potential of +2.0 V. The surface hardness of the titanium foil in Example 4 was measured by nanoindentation and was confirmed to be about 18 GPa.

The titanium foil in Example 5 was made as in Example 1 except that the electrolytic pickling was performed by alternating electrolysis on the condition with a Coulomb amount of 5 C/dm$^2$.

The surface hardness of the titanium foil in Example 5 was measured by nanoindentation and was confirmed to be about 20 GPa.

<Anode Polarization Measurement>

Figure 3:
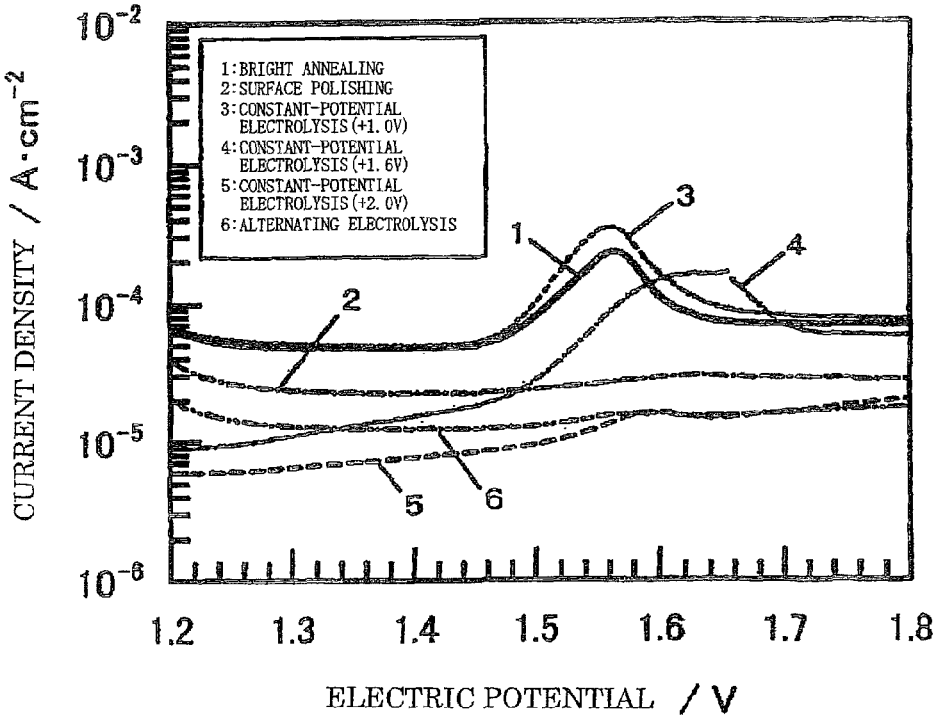
FIG. 3 is a graph showing anode polarization curves.

The results of anode polarization measurement performed on each of the titanium foils in Comparative Examples 1 and 3, Examples 3 to 5, and Reference Example 1 in 6 wt % nitric acid aqueous solution in the range from +1.2 V to +1.8 V are shown in FIG. 3.

An electric current peak was present at 1.56 V (saturated calomel electrode as reference, the same hereinafter) in Comparative Example 1 ("1" in FIG. 3) in which bright annealing alone was performed, while absent in Reference Example.

Accordingly, the peak is inherent to a film formed on the surface by bright annealing.

This is in agreement with the description on the results of elemental analysis by ESCA.

While an electric current peak was present at 1.56 V in Comparative Example 3 ("3" in FIG. 3) as similar to the measurement results in Comparative Example 1, an electric current peak for the titanium foil in Example 3 ("4" in FIG. 3) shifted toward the higher electric potential side compared to those in Comparative Examples 1 and 3 and no distinct peak was present for the titanium foils in Example 4 ("5" in FIG. 3) and Example 5 ("6" in FIG. 3) as similar to the titanium foil in Reference Example 1 ("2" in FIG. 3).

(Vickers Hardness Test)

Subsequently, hardness of the titanium foils in Comparative Examples 1 and 2 and Example 5 were measured with a Vickers hardness tester under the measuring load continuously changed from 0.05 kgf to 1 kgf.

Figure 4:
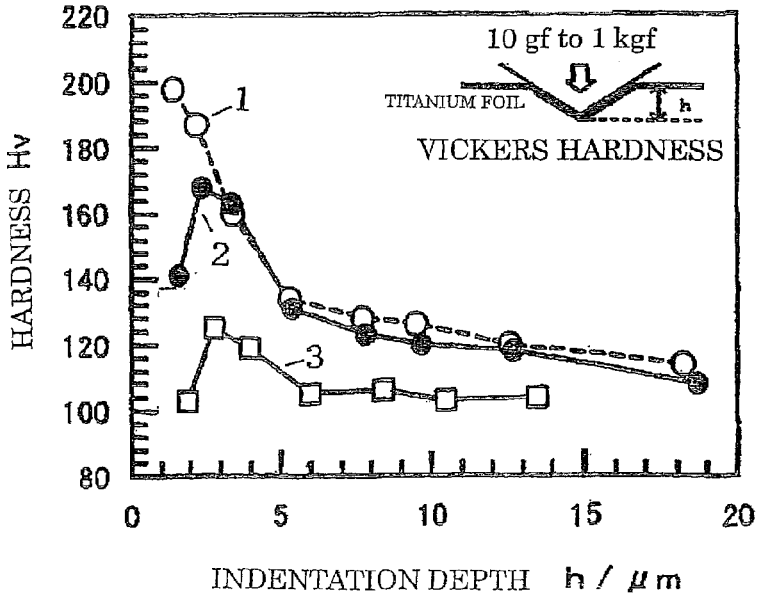
FIG. 4 is a graph showing a relationship between indentation depth and hardness in Vickers hardness test.

The relationships between the indentation depth of the diamond indenter under each load and the Vickers hardness are shown in FIG. 4.

The closer to the surface (the shallower the depth), the higher was the hardness of the titanium foil in Comparative Example 1 ("1" in FIG. 4), and about 200 Hv on the topmost surface side.

It is evident from this also that a hard layer was formed on the surface by annealing.

In contrast, the hardness of the titanium foil in Example 5 ("2" in FIG. 4) reached a peak value at the depth of 3 μm from the topmost surface and declined in the vicinity.

It is also shown that the hardness of the titanium foil in Example 5 was about 140 Hv on the topmost surface side.

In addition, although it was shown that the titanium foil in Comparative Example 2 ("3" in FIG. 4) was provided with a surface film having a two-layer structure as similar to the titanium foil in Example 5, the hardness was low as shown in the results in Table 1, with a measured hardness of about 110 Hv by this Vickers hardness test.

It is shown from the results of this Vickers hardness test and the hardness test of the surface layer by the nanoindentation also that a titanium material having excellent surface characteristics is not produced with a surface film having two-layer structure alone unless a necessary level of the surface hardness is achieved.

More specifically, in the case that the surface hardness by nanoindentation is lower than 5 GPa, the surface lubricity of the titanium material is not sufficiently provided, resulting in not only the large rolling force required for processing such as rolling but also possible disfigurement after processing due to the occurrence of abrasive powder.

On the other hand, in the case of higher than 20 GPa, the surface lubricity of the titanium material is also not sufficiently provided, resulting in the possible wear of the work roll or formation of scratches on the processed surface due to flaked portion of the surface of the titanium material.

From the results described above, it is recognized that the titanium material of the present invention has excellent surface characteristics such as surface lubricity and corrosion resistance.

The method for producing a titanium material of the present embodiment enables providing the titanium material with a homogeneous surface of titanium oxide by a convenient process, namely electrolytic pickling. The producing method is particularly suitable for producing a titanium material to be coated or plated.

The invention claimed is:

1. A titanium material comprising:

a surface film having a multilayer structure provided with at least two layers, namely a surface layer and an inner layer in contact with an inner side of the surface layer;

the surface layer being formed of titanium oxide and having a hardness of 5 GPa to 20 GPa and a thickness of less than 100 nm to prevent interference colors of the titanium material; and the inner layer containing at least one of titanium carbide and titanium nitride.

2. The titanium material of claim 1, wherein the titanium material is in the form of a foil.

* * * * *